US006783043B2

(12) United States Patent
Jakob et al.

(10) Patent No.: US 6,783,043 B2
(45) Date of Patent: Aug. 31, 2004

(54) PORTABLE SETTING TOOL FOR FASTENING ELEMENTS

(75) Inventors: Robert Jakob, Feldkirch (AT); Norbert Welte, Klaus (AT); Dionys Schalbetter, Haag (CH)

(73) Assignee: Hilti Aktiengesellchaft, Schaan (LI)

( * ) Notice: Subject to any disclaimer, the term of this patent is extended or adjusted under 35 U.S.C. 154(b) by 0 days.

(21) Appl. No.: 10/292,790

(22) Filed: Nov. 12, 2002

(65) Prior Publication Data

US 2003/0098329 A1 May 29, 2003

(30) Foreign Application Priority Data

Nov. 19, 2001 (DE) ..... 201 19 463 U

(51) Int. Cl.[7] ..... B27F 7/17

(52) U.S. Cl. ..... 227/8; 227/119; 227/120; 227/123; 227/126; 227/10

(58) Field of Search ..... 227/10, 126, 151, 227/8, 9, 123, 119–120

(56) References Cited

U.S. PATENT DOCUMENTS 3,086,207 A * 4/1963 Lingle ..... 227/123
3,946,927 A * 3/1976 Fehrs ..... 227/126
4,374,567 A * 2/1983 Combette et al. ..... 227/10
4,655,380 A * 4/1987 Haytayan ..... 227/9
5,048,740 A * 9/1991 Beton ..... 227/10
6,186,386 B1 * 2/2001 Canlas et al. ..... 227/8
6,267,284 B1 * 7/2001 Clark ..... 227/8
6,272,782 B1 * 8/2001 Dittrich et al. ..... 227/9
6,378,752 B1 * 4/2002 Gaudron ..... 227/10
6,708,860 B1 * 3/2004 Thieleke ..... 227/120

* cited by examiner

*Primary Examiner*—Scott A. Smith
*Assistant Examiner*—Michelle Lopez
(74) *Attorney, Agent, or Firm*—Sidley Austin Brown & Wood, LLP

(57) ABSTRACT

A portable setting tool includes a housing (2), a guide tube (3) for guiding the fastening elements and connectable with the housing and having a side cut-out through which the fastening elements are fed into the guide tube (3), and a feeler (13) extendable into the guide tube (3) at a location opposite the cut-out (11) of the guide tube (3) and having, at an end thereof extendable into the guide tube (3), an end surface (13*a*) providing for displacement of the feeler (13) in a direction transverse t a longitudinal axis (14) of the guide tube (3) upon being acted upon by a fastening element, and an adjusting rim (17) adjoining the end surface (13*a*) and forming, with a longitudinal axis (14) of the guide tube (3), an acute angle (α1) opening in a direction toward a mouth opening of the guide tube (3) with the adjusting rim providing for displacement of the feeler (13) in the transverse direction upon being acted upon by an object displaceable along the longitudinal axis (14) of the guide tube (3).

5 Claims, 2 Drawing Sheets

PORTABLE SETTING TOOL FOR FASTENING ELEMENTS

BACKGROUND OF THE INVENTION

1. Field of the Invention

The present invention relates to a portable setting tool for fastening elements and including a housing, a guide tube for guiding the fastening elements, connectable with the housing and having a side cut-out through which the fastening elements are fed into the guide tube, and a feeler extendable into the guide tube at a location opposite the cut-out of the guide tube and displaceable in a direction away from the guide tube.

2. Description of the Prior Art

A setting tool of a type described above is disclosed in a German Publication DE-19950 349A1. The setting tool includes a guide tube for guiding the fastening elements and having a side cut-out through which the fastening elements are fed into the guide tube, and a feeler engaging into the guide tube at a location opposite the cut-out of the guide tube and displaceable in a direction away from the guide tube.

For ejecting a fastening element from the guide tube, a piston rod of a piston in driven into the guide tube, impacting the fastening element. A piston plate, which is connected with the piston rod, adjoins a combustion chamber. The piston drive energy is generated by ignition of a suitable combustible gas mixture, e.g., air/fuel gas mixture.

For safety reason, in setting tools described above, often, a press-on sleeve which is slidably supported on the guide tube, is used. The press-on sleeve insures that a setting process, i.e., driving of a fastening element in an object only then becomes possible when the setting tool is pressed against the object. When the setting tool is pressed against the object, the press-on sleeve is displaced against a biasing force rearwardly with respect to the guide tube. During its displacement, the press-on sleeve alternatively cooperates with mechanical locking means and/or mechanical or electrical switches which only then allow actuation of a trigger and/or release of the drive energy when the press-on sleeve was depressed by a predetermined minimum amount.

Setting tools of this type are often equipped with magazines and have additional locking functions associated with determination whether a magazine has been secured to the setting tool, whether the number of fastening elements in the magazine is sufficient, and whether the fastening elements are properly position in the magazine or the guide tube. Only when a positive determination has been made, the setting process can be initiated.

Preferably, the fastening elements are arranged in a strip or a band and in this condition are placed in the magazine. The displacement within the magazine is effected by a biasing force so that a next fastening element can be advanced in the guide tube and be driven into an object.

If the setting tool is equipped with a feeler of the type described above, the pressure of a fastening element in the guide tube is determined based on a projecting depth of the feeler into the guide tube. The feeler also permits to determine whether the fastening element occupies a correct position in the guide tube. When there is no fastening element in the guide tube or the fastening element has not been advanced sufficiently far into the guide tube, the feeler can project into the guide tube so far that effecting a setting process or initiation of the ignition, associated with the setting process is not possible. The operation of the setting tool is blocked until a fastening element is properly positioned in the guide tube, which corresponds to a minimal penetration depth of the feeler.

Further, during setting of fastening elements, from time to time, either a fastening element or the fastening element-carrying strip breaks and becomes jammed in front or behind the feeler. Then, a regular operation of the setting tool is not possible.

Accordingly, an object of the invention is to so improve a setting tool of the type described above that clearing of the guide tube from pieces of a broken fastening element or strip can be easily effected without a danger of damaging the feeler.

SUMMARY OF THE INVENTION

This and other objects of the present invention, which will become apparent hereinafter are achieved by providing a setting tool with a feeler that has at its end extendable into the guide tube, an adjusting rim forming, with a longitudinal axis of the guide tube, an acute angle opening in a direction toward a mouth opening of the guide tube.

In case when a broken piece of a fastening element or of a fastening element holder becomes jammed in the guide tube in the region of the feeler, the broken piece can be easily removed by inserting a clearing tool in the guide tube from the guide tube mouth opening. The broken piece or the clearing tool, by engaging the adjusting rim, easily displaces the feeler radially outwardly, so that the broken piece is easily pushed out of the guide tube. The easy radial displacement of the feeler eliminates any danger of the feeler being damage. This significantly increase the service life of a guide tube unit that includes the feeler.

According to a further development of the present invention, there is provided, at the end of the feeler extendable into the guide tube, another adjusting rim that forms with the longitudinal axis of the guide tube an acute angle opening in a direction opposite the mouth opening of the guide tube. The other adjusting rim insures an easy removal of jammed piece from the setting tool side of the guide tube. This is because the feeler will also be displaced radially outwardly with the broken piece or the clearing tool, without being damaged. A clearing tool can be formed as a clearing rod insertable into the guide tube.

As it follow from the foregoing description, the broken pieces, which are located immediately in front and/or behind the feeler are easily removed, without damaging the feeler. As even in this case, it is insured that the feeler is easily displaced radially outwardly by the broken pieces, without being damaged, due to the adjusting rims. Advantageously, clearing of the guide tube is effected after the guide tube has be lifted off the setting tool.

When both adjusting rims of a feeler, which projects into the guide tube to a full extent, lie in the inner circumferential region of the guide tube, the rod-shaped clearing tool could have a maximal diameter only slightly smaller than the inner diameter of the guide tube. In this case, it is always insured that the clearing tool is advanced against the slope of the first or second adjusting rim for displacing the feeler radially outwardly, without damaging the feeler.

Generally, the feeler is displaced linearly into and out of the guide tube. However, the feeler can also be pivotally arranged so that it would pivot into or out of the guide tube.

The novel features of the present invention, which are considered as characteristic for the invention, are set forth in the appended claims. The invention itself, however, both as to is construction and its mode of operation, together with additional advantages and objects thereof, will be best understood from the following detailed description of preferred embodiments, when read with reference to the accompanying drawings.

DETAILED DESCRIPTION OF A PREFERRED EMBODIMENT

Figure 1:
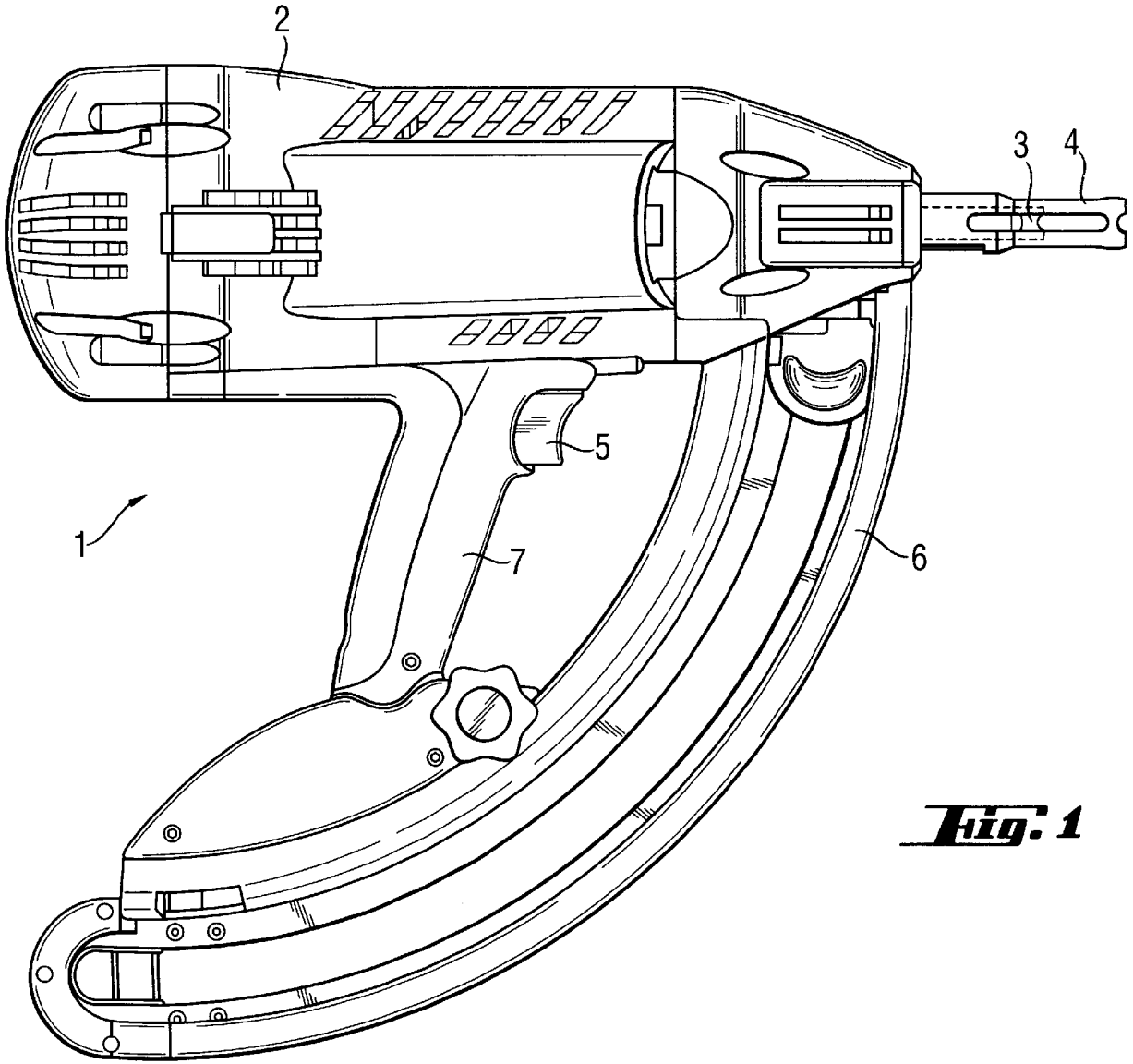
FIG. 1 a side view of a portable combustion-engined setting tool for fastening elements according to the present invention.

A setting tool according to the present invention, which is shown in FIG. 1, is designated with a reference numeral 1 and includes a housing 2, a guide tube 3 and a press-on sleeve 4. The guide tube 3 and the press-on sleeve 4 both project from the housing 2 in a setting direction. The press-on sleeve 4 is slidably supported on the guide tube 3 concentrically therewith. The press-on sleeve 4 is displaced into the interior of the housing 2 when the setting tool 1 with the press-on sleeve 4 is pressed against an object into which a fastening element is to be driven. When the press-on sleeve 4, upon being displaced, reaches its end position, the locking of the setting tool 1 is released, and a drive-in process can be initiated by actuation of a trigger 5. The actuation of the trigger 5 leads to ignition, by an electrical ignition device, of a combustible gas mixture, e.g., air/fuel gas mixture, in the combustion chamber of the setting tool 1. The generated pressure acts on a piston plate connected with a piston rod that is driven into the guide tube 3 to eject a fastening element located in the guide tube 3 from the guide tube 3. The fastening elements are arranged in a strip or a band that provides for connection of the fastening elements with each other and forms a magazine 6 of fastening elements and extending between the front section of the setting tool 1 and the handle 7. However, the present invention is not limited to the setting tool shown in the drawing and can be used with other types of setting tools.

Figure 2:
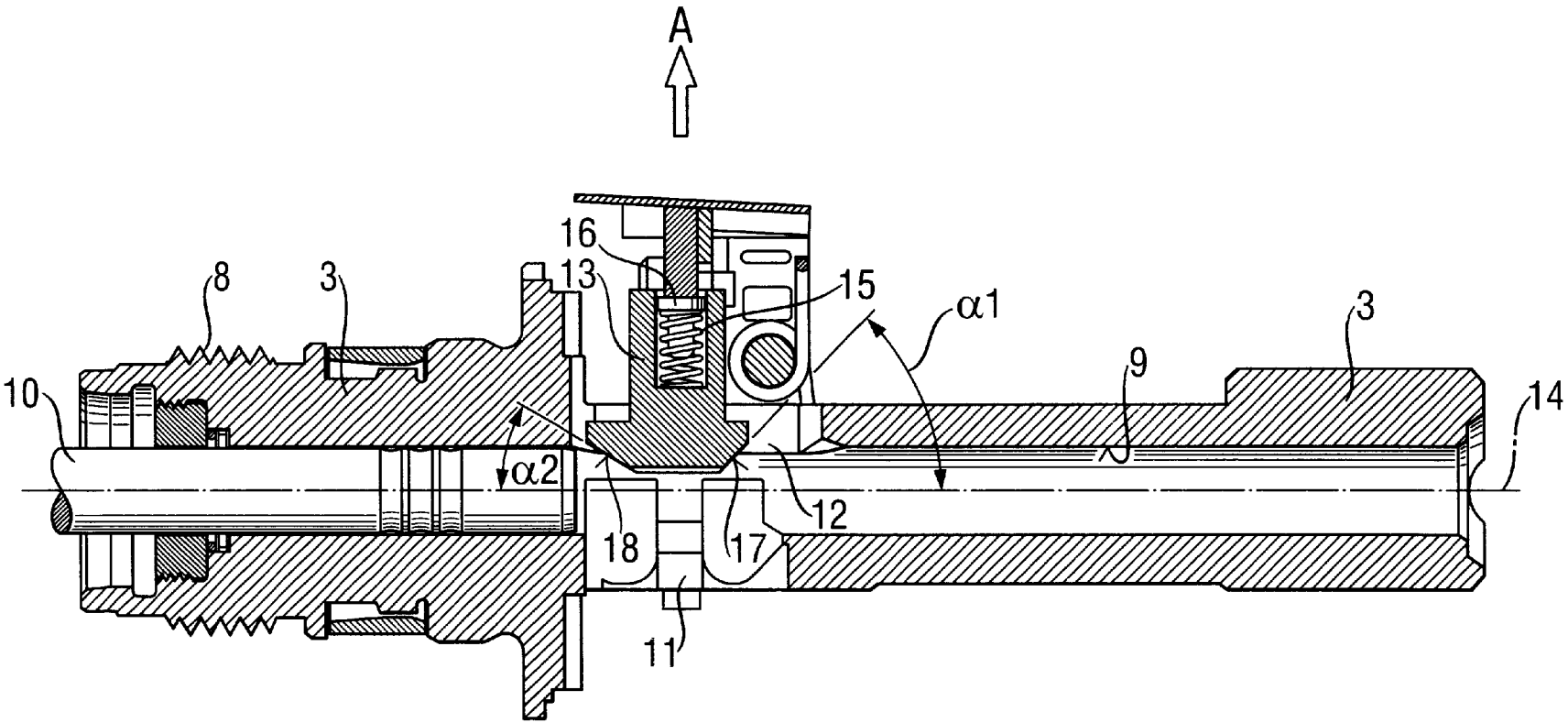
FIG. 2 an axial cross-sectional view of a guide tube located in the front section of the setting tool shown in FIG. 1, together with a feeler for fastening elements.

As shown in FIG. 2, the unit, which includes the guide tube 3, has an outer thread 8 provided on the guide tube and with which the unit is screwed to the tip of the setting tool 1 so that the piston rod 10 of the drive piston is received in an inner channel 9 of the guide tube 3. At its rear end, the piston rod 10 is connected with a piston plate (not shown) connected with the combustion chamber (not shown). As it has already been discussed above, upon actuation of the trigger 5, the electrical ignition device ignites the air/fuel gas mixture, whereby the piston plate is displaced in the setting direction, displacing the piston rod 10 further into the inner channel 9 of the guide tube 3, pushes a fastening element located in the inner channel 9 out of the guide tube 3. This, however, becomes only then possible, when the setting tool 1 with its press on sleeve 4 was pressed against an object, into which a fastening element is to be driven, to such an extent that the press-on sleeve 4 reached its rearmost position. Only then, e.g., an electrical or mechanical locking of the trigger 5 can be lifted.

Fastening elements that form the strip-shaped magazine 6 can be in form of nails which are provided in their head region with a plastic collar. The plastic collars provide for connection of the fastening elements with each other. The strip or band with fastening elements is preloaded in a direction toward the guide tube 3 with a spring-biased press-on device located in the magazine 6. Thereby, the frontmost fastening element is always pushed into the inner channel 9 through a cut-out 11 in the wall of the guide tube 3. To this end, the head portion of the magazine 6 is arranged in the cut-out 11, and a fastening element reaches the inner channel 9 through the magazine head portion.

As shown in FIG. 2, opposite the cut-out 11, there is provided another cut-out 12 in the wall of the guide tube 3. The cut-out 12 is located somewhat opposite the collar of the fastening element. A plate-shaped feeler 13 is arranged in a plane, in which a longitudinal axis 14 of the guide tube 3 is located so that the plane of the feeler 13 coincides with this plane. The feeler 13 is displaceable in the plane of the guide tube axis 14. When fed, the fastening element lies parallel to the longitudinal axis 14. In FIG. 2, this is a plane of the drawing. The feeler 13 is biased in a direction toward the inner channel 9 by a compression spring 15. The compression spring 15 is supported against a holder 16 and tends to expand in a direction A, transverse to the guide tube longitudinal axis 14.

When there is no fastening element in the inner channel 9 of the guide tube 3, the compression spring 15 biases the feeler 13 into the inner channel 9 so that the feeler 13 projects into the inner channel 9 to a maximum possible extent. In this position, the feeler 13 prevents the press-on sleeve 4 from reaching its rear end position when the press-on sleeve is displaced rearwardly upon the setting tool being pressed against an object. As a result, actuation of the setting tool is not possible.

When a fastening element is located in the inner channel 9 of the guide tube 3, the fastening element lies along the longitudinal axis 14. The fastening element, when fed into the inner channel 9, acts on end surface 13*a* of the filler 13 and displaces the feeler 13, whereby the press-on sleeve 4 is released and can be displaced to its rear end position. As soon as the press-on sleeve 4 reaches its rear end position, the ignition process can be initiated. In its displaced position, the feeler 13 slightly projects into the inner channel 9.

In case a fastening element breaks within the guide tube 3 and becomes jammed in the inner channel 9, the parts of the fastening element should be extracted form the inner channel 9. This can be effected by unscrewing the guide tube unit from the setting tool. Then, a rod-shaped clearing tool, an outer diameter of which is only slightly smaller than the inner diameter of the channel 9, can be pushed into the inner channel 9 from the setting tool side or the mouth side pressing out parts of the broken fastening element out of the inner channel 9, without any damage of the feeler 13. The feeler 13 is provided, at its end extendable into the inner channel 9, with an adjusting rim 17 adjoining the end surface 13*a* and forming, with the longitudinal axis 14 of the guide tube 3, an acute angle $\alpha 1$ that opens toward the mouth opening of the guide tube 3. When the rod-shaped clearing tool is pushed in the inner channel 9 from the mount opening side, either the parts of the fastening element or the clearing tools itself engage the adjusting rim 17, pushing the feeler 13 radially away from the inner channel 9, which prevents any damage of the feeler. Thus, when further displaced, the parts of the fastening element or the clearing tool do no run past the edge of the feeler 13 which extends transverse to the longitudinal axis 14 of the guide tube 3.

The same measures for preventing any damage of the feeler 13 are undertaken when the clearing is effected from the setting tool side. The feeler 13 is provided, at its end extendable into the inner channel 9, with a second, setting tool side, adjusting rim 18, forming with the longitudinal axis 14 of the guide tube 3 and acute angle $\alpha 2$ facing in a setting tool side direction, i.e., away from the guide tube mouth opening. Thus, clearing can be effected from the setting tool side without damaging the feeler 13.

The second adjusting rim 18 also protects the feeler 13 from being damaged by the piston rod 10 advancing into the inner channel 9 of the guide tube 3 and which displaces the feeler 13 radially outwardly in the same manner the clearing tool does.

Though the present invention was shown and described with references to the preferred embodiment, such is merely illustrative of the present invention and are not to be construed as a limitation thereof and various modifications of the present invention will be apparent to those skilled in the art. It is therefore not intended that the present invention be limited to the disclosed embodiment or details thereof, and the present invention includes all variations and/or alternative embodiments within the spirit and scope of the present invention as defined by the appended claims.

What is claimed is:

1. A portable setting tool for fastening elements, comprising a housing (2); a guide tube (3) for guiding the fastening elements, connectable with the housing and having a side cut-out through which the fastening elements are fed into the guide tube (3); and a feeler (13) extendable into the guide tube (3) at a location opposite the cut-out (11) of the guide tube (3) and displaceable in a direction away from the guide tube (3), the feeler (13) having, at an end thereof extendable into the guide tube (3), an end surface **(13*a*) providing for displacement of the feeler (13) in a direction transverse to a longitudinal axis (14) of the guide tube (3) upon being acted upon by a fastening element, and an adjusting rim (17) adjoining the end surface (13*a*) and forming, with a longitudinal axis (14) of the guide tube (3), an acute angle $(\alpha 1)$ opening in a direction toward mouth opening of the guide tube (3), the adjusting rim providing for displacement of the feeler (13) in the transverse direction upon being acted upon by an object displaceable along the longitudinal axis (14) of the guide tube (3)**.

2. A setting tool according to claim 1, wherein the feeler (13) has at an end thereof extendable into the guide tube (3), another adjusting rim (18) forming, with a longitudinal axis (14) of the guide tube (3), an acute angle $(\alpha 2)$ opening in a direction opposite the mouth opening of the guide tube (3).

3. A setting tool according to claim 2, wherein both adjusting rims (17,18) are located, at a frill extension of the feeler (13) into the guide tube (3), at an inner circumferential region of the guide tube (3).

4. A setting tool according to claim 1, wherein the feeler (13) is linearly displaceable.

5. A guide tube assembly for a setting tool for fastening elements, comprising a guide tube (3) for guiding the fastening elements and having a side cut-out through which the fastening elements are fed into the guide tube (3); and a feeler (13) extendable into the guide tube (3) at a location opposite the cut-out (11) of the guide tube (3) and displaceable in a direction away from the guide tube (3), the feeler (13) having, at an end thereof extendable into the guide tube (3), an end surface **(13*a*) providing for displacement of the feeler (13) in a direction transverse to a longitudinal axis (14) of the guide tube (3) upon being acted upon by a fastening element, and an adjusting rim (17) adjoining the end surface (13*a*) and forming, with a longitudinal axis (14) of the guide tube (3), an acute angle $(\alpha 1)$ opening in a direction toward a mouth opening of the guide tube (3), the adjusting rim providing for displacement of the feeler (13) in the transverse direction upon being acted upon by an object displaceable along the longitudinal axis (14) of the guide tube (3)**.

* * * * *